US007189123B2

(12) United States Patent
Orange et al.

(10) Patent No.: US 7,189,123 B2
(45) Date of Patent: Mar. 13, 2007

(54) LAWN AND GARDEN BATTERY CLAMP

(75) Inventors: Charles M. Orange, Nashville, TN (US); Steve Eller, Goodlettsville, TN (US)

(73) Assignee: Batlock, LLC, Nashville, TN (US)

( * ) Notice: Subject to any disclaimer, the term of this patent is extended or adjusted under 35 U.S.C. 154(b) by 0 days.

(21) Appl. No.: 11/114,201

(22) Filed: Apr. 26, 2005

(65) Prior Publication Data

US 2006/0240676 A1 Oct. 26, 2006

(51) Int. Cl.
*H01R 4/50* (2006.01)

(52) U.S. Cl. ..... 439/773

(58) Field of Classification Search ..... 439/773, 439/772

See application file for complete search history.

(56) References Cited

U.S. PATENT DOCUMENTS

| | | | | |
|---|---|---|---|---|
| 3,084,306 | A * | 4/1963 | Cribbs | 439/761 |
| 4,997,396 | A * | 3/1991 | Gold et al. | 439/801 |
| 5,064,325 | A * | 11/1991 | McRoskey | 411/368 |
| 6,773,310 | B2 * | 8/2004 | Davis | 439/773 |
| 6,802,747 | B1 * | 10/2004 | Orange | 439/773 |
| 6,971,925 | B1 * | 12/2005 | Orange | 439/773 |

* cited by examiner

*Primary Examiner*—Gary F. Paumen
(74) *Attorney, Agent, or Firm*—Miller & Martin PLLC

(57) ABSTRACT

An improved battery cable clamp provides for toolless attachment of battery cable connectors to lawn and garden-type battery terminal posts utilizing a bossed handle, cam seat and thumbnut, preferably made of non-corrosive materials.

19 Claims, 3 Drawing Sheets

LAWN AND GARDEN BATTERY CLAMP

FIELD OF THE INVENTION

The present invention relates generally to battery cable clamps and more particularly a clamp designed to connect a battery cable to a lawn and garden type battery post.

BACKGROUND OF THE INVENTION

Many items of lawn and garden power equipment are now started or operated with battery power. For instance, many lawn tractors intended for both commercial and home use are started by battery power from lawn and garden style batteries. Other work and recreational equipment such as all terrain vehicles and jet skis also use this style battery. The standard lawn and garden battery has upstanding flat metal terminal posts with apertures to receive a bolt. The usual lawn and garden battery cable ends with a flat round metal connector with an aperture that may also be received over a bolt. Thus, the bolt is passed through openings in both the metal terminal post and the round cable connector. The nut is then threaded on the bolt and presses the flat round connector and flat terminal post together to create an electrically conductive connection.

Because lawn and garden equipment in many cases generates a substantial vibration, it is not uncommon for the nut and bolt fastener to come loose and for the quality of the electrical connection to become diminished. Furthermore, since some types of lawn and garden equipment are designed with the goal of consuming very little space, on occasion lawn and garden battery placement is in a confined location making it difficult to fasten and unfasten a nut and bolt connection. Such fastening and unfastening may require partial disassembly of the equipment in order to have proper access to the terminal and battery connector. Furthermore, on occasion the battery and connector become subject to corrosion. This corrosion may impair the proper transmission of battery power from the battery terminal post through the battery cable connector, thereby diminishing the electrical power. To remedy the diminished transmission of power, the battery connector has to be removed, corrosion brushed away from the connector and the terminal post and then the parts reconnected. When there is corrosion, loosening the nut on the bolt may be difficult as there may also be corrosion locking the nut on the bolt. In addition, if the battery is spent, the old battery must be removed and replaced with a new one.

What is needed, then, is a battery clamp that easily and securely fastens a lawn and garden type battery cable connector to a lawn and garden battery terminal post, that is corrosion resistant and that can be fastened and unfastened without tools.

SUMMARY OF THE INVENTION

Instead of a standard bolt passing through the battery cable connector and lawn and garden battery post, the battery cable clamp of the invention is effectively a bolt with a clamping handle and an easily removed fastener. The connection between the bolt head and the attached handle includes a boss or camming structure that increases or decreases the clamping pressure of the bolt based upon a small rotation of the handle. Thus, the fastener on the bolt connecting the battery cable connector to the terminal post can be tightened finger-tight and the handle pivoted approximately 90° to substantially increase the clamping pressure applied to the battery cable connector and terminal post. When it is desired to remove the battery cable clamp, the handle can be pivoted in the opposite direction and a substantial decrease in the clamping pressure results. The fastener on the bolt can then be easily loosened and removed so that the battery cable clamp can be removed and the battery cable connector detached from the battery terminal post. Preferably at least the handle, fastener and seat interfacing with the boss on the handle are made of non-corrosive and even non-metallic materials. Such a battery cable clamp is operable without the need for the use of any additional tools.

DETAILED DESCRIPTION OF THE INVENTION

Figure 5A:
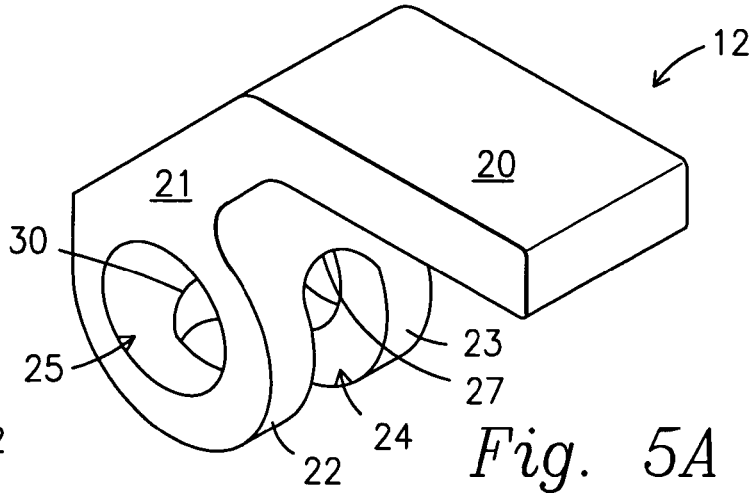
FIG. 5A is a perspective view of a handle designed for use in an embodiment of the present invention.
Figure 5B:
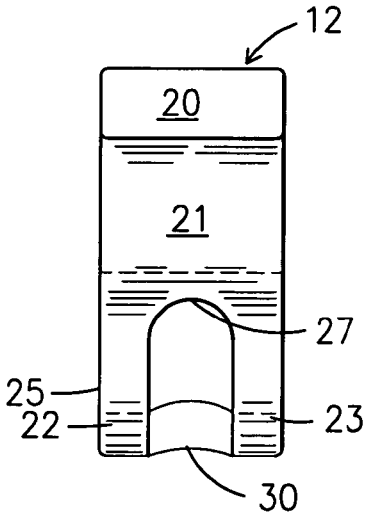
FIG. 5B is a front plan view of the handle of FIG. 5A.
Figure 5C:
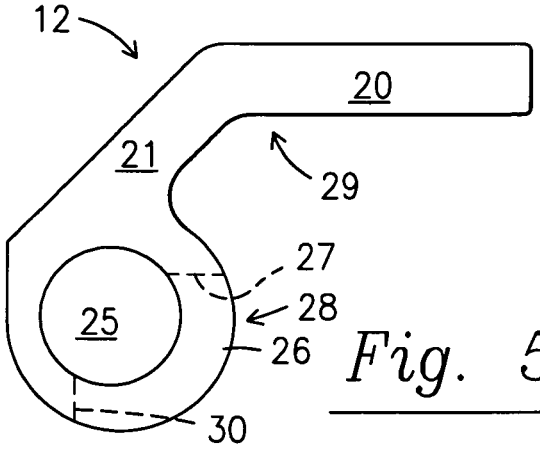
FIG. 5C is a side plan view of the handle of FIG. 5A.
Figure 6:
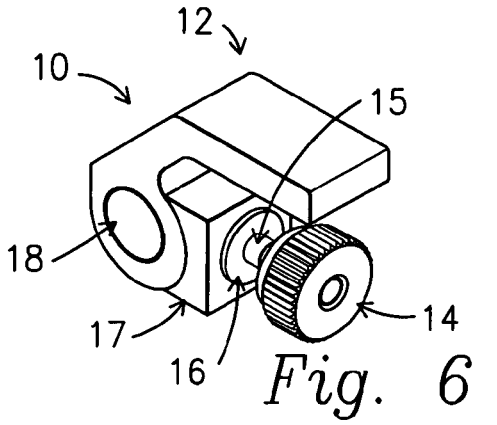
FIG. 6 is a perspective view of an assembled embodiment of a battery cable clamp according to the present invention.
Figure 7:
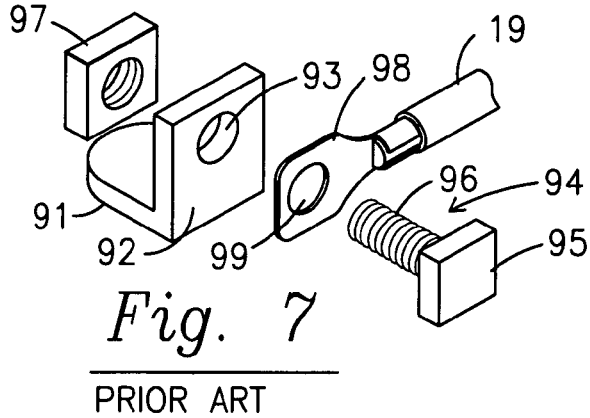
Fig. 7 PRIOR ART
FIG. 7 is an illustration of the prior art bolt used to join a battery cable connector to a battery terminal post.

A description of the preferred embodiment of the present invention will be best understood by referring to FIGS. 1–8 of the accompany drawings. Referring first to FIG. 7, a representative prior art connection is shown. Lawn and garden battery terminal post 91 has base and upstanding rectangular panel 92 with aperture 93. Lawn and garden type battery cables 19 typically have flat rounded plate-like in the form of flat metal plate end connectors 98 with aperture 99. Apertures 93, 99 of battery terminal post 91 and cable connector 98 respectively, are aligned and the shaft 96 of bolt 94 is passed through those apertures 93, 99. Nut 92 is fastened on the threaded shaft 96 and the bolt head 95 and tightened so that nut 92 compress battery cable connector 98 against rectangular plate 92 of battery terminal post 91 to establish an electrical connection.

FIG. 6 shows an embodiment of a battery clamp 10 according to the present invention which is used to replace the nut 92 and bolt 94 assembly of the prior art. The principal components of the battery cable clamp are handle 12, fastener such as knurled thumb nut 14, connecting rod or shaft 15, washer 16, cam seat 17, and pin 18. These components may be examined in greater detail in FIGS. 1–5.

Figure 1A:
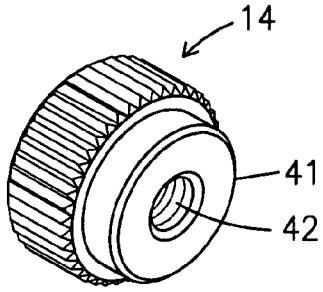
FIG. 1A is a perspective view of a thumb nut type fastener that may be utilized in an embodiment of the invention.
Figure 1B:
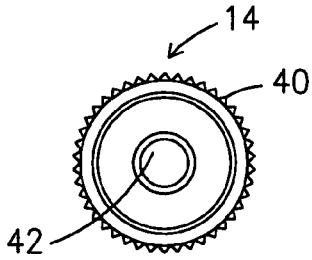
FIG. 1B is an end plan view of the thumb nut fastener of FIG. 1A.
Figure 1C:
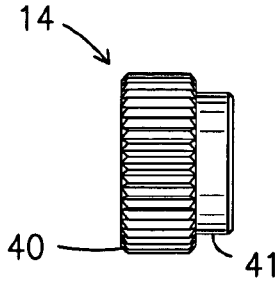
FIG. 1C is a side plan view of the thumb nut fastener of FIG. 1A.

Referring then to FIGS. 1A–1C, the fastener in the form of a thumb nut 14 is illustrated. Thumb nut 14 has a cylindrical body 41 and a raised knurled gripping surface 40. Threaded aperture 42 passes axially through thumb nut 14. The thumb nut 14 is preferably made of non-corrosive material such as glass-filled nylon, and the threaded aperture 42 may be defined by a stainless steel or other rust-resistant metal insert about which the glass-filled nylon is formed or attached. The insert is preferably generally cylindrical and defines a threaded lumen to receive the distal end 53 at the connecting rod 15. It will be understood that other fasteners such as wing nuts and the like may be used if desired.

Figure 2A:
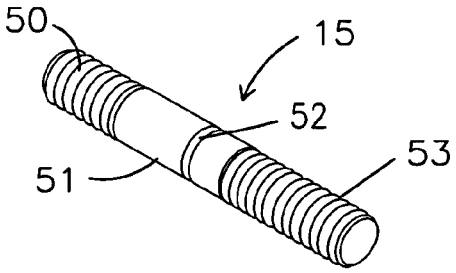
FIG. 2A is a perspective view of an embodiment of a connecting rod that may be utilized in the present invention.
Figure 2B:
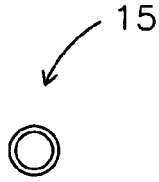
FIG. 2B is an end plan view of the connecting rod of FIG. 2A.
Figure 2C:
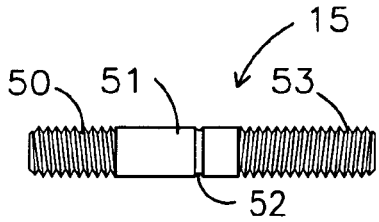
FIG. 2C is a side plan view of the connecting rod of FIG. 2A.

The shaft or connecting rod 15 is shown in FIGS. 2A–2C. The connecting rod 15 has a threaded distal end 53 which is received in the threaded aperture 42 of the thumb nut. The connecting rod 15 also has a threaded proximal end 50 which is received in pivot pin 18. Intermediate section 51 of connecting rod 15 has a channel 52 which aids in the positioning of washer 16.

Figure 3A:
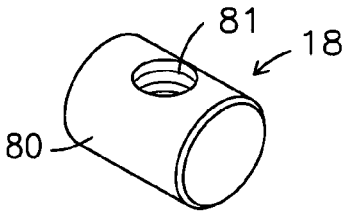
FIG. 3A is a perspective view of a pin that may be mounted in the handle and connected to a connecting rod according to the present invention.
Figure 3B:
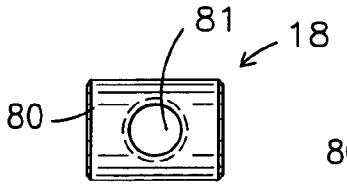
FIG. 3B is a top plan view of the pivot pin of FIG. 3A.
Figure 3C:
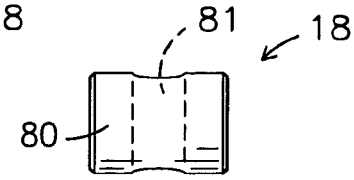
FIG. 3C is a side plan view of the pivot pin of FIG. 3A.

Pivot pin 18 is shown in FIGS. 3A–3C. Pivot pin 18 has a cylindrical body 80 and threaded aperture 81 extending through the pin in a direction normal to the axis of the cylindrical body 80.

Figure 4A:
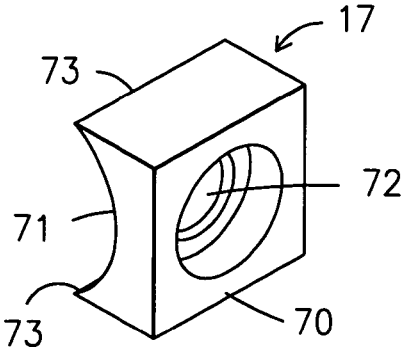
FIG. 4A is a perspective view of a cam base or seat designed for use in an embodiment of the present invention.
Figure 4B:
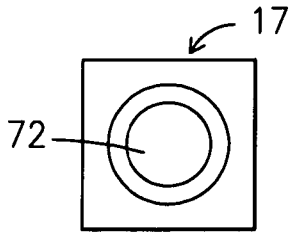
FIG. 4B is a top plan view of the seat of FIG. 4A.
Figure 4C:
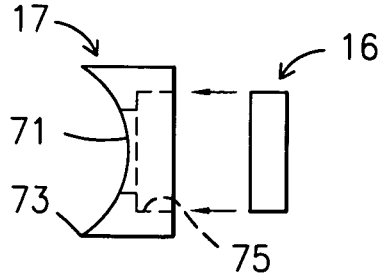
FIG. 4C is a left side plan view of the seat of FIG. 4A showing a removed elastomeric washer.
Figure 4D:
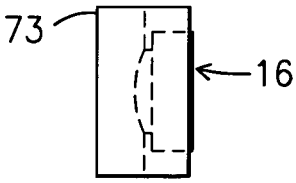
FIG. 4D is a right side plan view of the seat of FIG. 4A showing the elastomeric washer in place.

The seat or cam base 17 is illustrated in FIGS. 4A–4D together with elastomeric washer 16. The cam seat has a base surface 70 and an opposed concave cam surface 71 formed by opposed raised edges 73 and central channel 74. The cam seat may also advantageously be formed of glass-filled nylon. In the center of cam surface 71 is aperture 72 sized to allow passage of connecting rod 15. On the base side 70 the aperture 72 is radially enlarged to form cylindrical cavity 75 which receives elastomeric washer 16 as shown in FIGS. 4C and 4D. Preferably the elastomeric washer 16 will be only slightly thicker than cavity 75 so that the washer may act to damp some of the vibration of a typical lawn and garden apparatus.

Figure 8A:
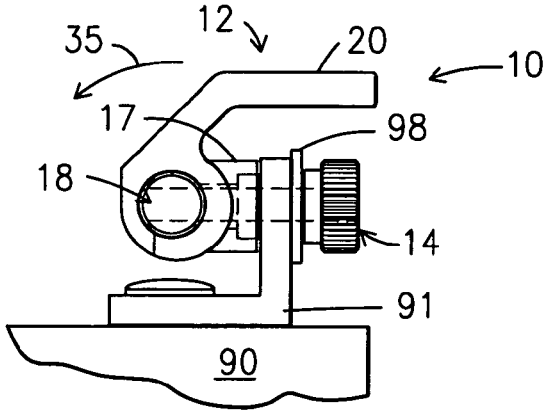
FIG. 8A is a side plan view of a battery cable clamp according to the present invention used to fasten a battery cable connector between the fastening nut and battery terminal post.
Figure 8B:
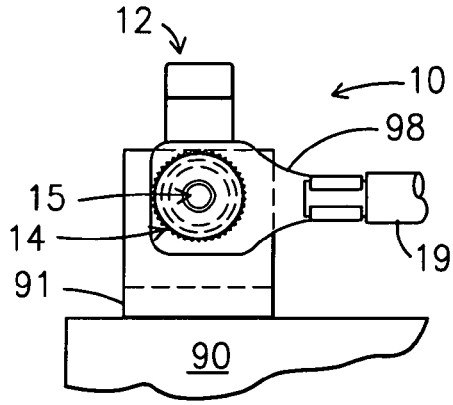
FIG. 8B is an end plan view of a battery cable clamp according to the present invention used to fasten a battery cable connector between a battery terminal post and cam seat.
Figure 8C:
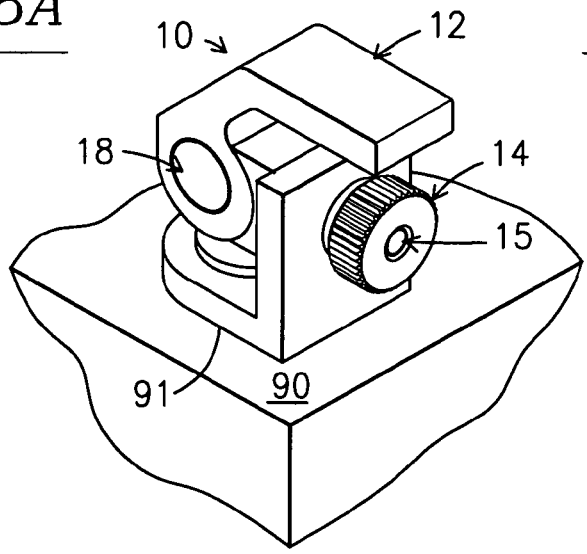
FIG. 8C is a perspective view of a cable clamp according to the present invention mounted in a lawn and garden type battery terminal post with no battery cable attached.

FIGS. 5A–5C show the handle 12 in isolation. The handle 12 has a base section 28 encircling a transverse aperture 25 that receives pin 18, and handle section 29 which in the illustrated embodiment includes horizontal grip section 20 and angled section 21. The handle 12 may advantageously be made from glass-filled nylon. Handle section 29 operates to rotate base section 28 about pin 18. Base section 28 is divided into a left wing 22 and a right wing 23 separated by channel 24. Channel 24 allows the proximal end 50 of connecting rod 15 to be received within threaded aperture 81 of pivot pin 18, when the pin 18 is mounted in aperture 25. Furthermore, channel 24 extends from a forward stop wall 27 to a rear stop wall 30. The connecting rod is pivotable in the channel between the forward stop wall 27 and the rear stop wall 30 through an arc of at least about 90 and up to about 180 degrees. Preferably the angular orientation of the connecting rod 15 when pivoted against forward stop wall 27 is parallel to the horizontal handle section 20. In this fashion, the clamp presents a compact profile over the battery terminal post 91 when clamped in place as shown in FIGS. 8A–8C. The left and right wings 22, 23 each have a bossed section 26 that is rotatable into contact with cam surface 71 of cam seat 17. The bossed section is preferably forward of the transverse aperture 25. When bossed section 26 is rotated into contact with cam surface 71, pivot pin 18 is necessarily moved further away from cam seat 17 and the corresponding movement of the connecting rod 15 caused fastener 14 on connecting rod 15 to be moved closer to cam seat 17. Where the bossed section 26 is rotated out of contact with cam surface 71, the fastener 14 is moved further from cam seat 17.

To employ the battery cable clamp 10, the fastener 14 must be removed from the connecting rod 15. Then the distal end 53 of the connecting rod 15 is passed through the aperture 93 of the terminal post 91 and aperture 99 of the cable connector plate 98. While this is being done, a retainer such as elastomeric washer 16 retains the seat 17 or the connecting rod 15. The retainer may be made integral with the seat or a separate component such as the illustrated washer 16. While the retainer may be removable from connecting rod 15, it impedes the removal of seat 17 from the rod.

When the connecting rod 15 has been passed through the terminal post 91 and cable connector plate 98, the handle 12 should be rotated with respect to the seat 17 so that the bossed sections 26 of the wings are substantially disengaged from the cam surface 71 of the seat 17. This is preferably accomplished by pivoting the handle 12 with respect to the connecting rod 15 and seat 17 thereon until the connecting rod is restrained by the rear stop wall 30. The fastener 14 is then finger tightened on the distal end 53 of connecting rod 53. Finally the handle 12 is pivoted with respect to the connecting rod 15 and seat 17 to bring the bossed sections 26 of the wings to rest on the cam surface 71 of the seat. Preferably this position is attained when the connecting rod 15 is pivoted into contact with the forward stop wall 27 and the grip section 20 is substantially parallel to the connecting rod. When the bossed section 26 is in contact with the cam surface 71, the distance between the cam seat 17 and fastener 14 is reduced (as the distance between the pivot pin 18 and cam seat 17 is correspondingly lengthened), and the terminal post 91 and cable connecting plate 98 are compressed to create a secure and efficient electrical connection.

FIGS. 8A and 8B illustrate the battery cable clamp 10 of the present invention used to hold battery cable connectors 98 in connect with battery terminal post 91. In FIG. 8A, the battery cable connector 98 is positioned between the battery terminal post 91 and the fastener 14. In FIG. 8B, the connector 98 is positioned between the battery terminal post 91 and the cam seat 17. In either case, the battery cable clamp 10 of the present invention creates an easily fastened and secure electrical connection between connector 98 and terminal post 91.

In order to unfasten the battery cable clamp of the present invention, reference may be had to FIG. 8A. First, the handle 12 is rotated about pivot pin 18 in direction 35. This removes the bossed section 26 from resting on cam surface 71 and thereby extends the distance between pivot pin 18 and fastener 14 and decreases the pressure applied to the connecting rod. This make is easier to unfasten thumb nut 14 which is removed from connecting rod 15. This allows battery cable connector 98 to be removed from the end of connecting rod 15 and for the remaining components of the battery cable clamp to be removed from the aperture 93 of the battery terminal post 91. The elastomeric washer 16 fitted on connecting rod 15 is snugged on the intermediate section 51 of connecting rod 15 and preferably engaged in channel 52. The elastomeric washer 16 will not easily slide distal of channel 52 or over threaded distal section 53 and thereby retains base 17 in proximity to handle 12 and connecting pin 18 rather than permitting the base 17 to slide off the connecting rod 15.

Although preferred embodiments of the present invention have been disclosed in detail herein, it will be understood that various substitutions and modifications may be made to the disclosed embodiment described herein without departing from the scope and spirit of the present invention as recited in the appended claims.

We claim:

1. An improved connector for a lawn and garden type battery and battery cable comprising:

(a) a handle having a grip section and a base section, the base section having a transverse aperture and having left and right wings separated by a channel;

(b) a pin received within the transverse aperture of the handle base section and extending across the channel therein;

(c) a connecting rod having a proximal end connected through the channel to the pin. an intermediate section, and a threaded distal section;

(d) a seat having an aperture through which the connecting rod is received, the seat having a concave cam surface facing the handle base section and an opposed base surface; and (e) a fastener that is received on the threaded distal section of the connecting rod wherein a retainer is mounted on the connecting rod to impede the removal of the seat from the rod.

2. The connector of claim 1 wherein the retainer is an elastomeric washer is received over the connecting rod and housed substantially within a cavity in the base surface of the seat.

3. The connector of claim 2 wherein the thickness of the elastomeric washer is slightly greater than the depth of the cavity in the base surface of the seat.

4. The improved connector of claim 1 wherein the handle base section channel is defined laterally by the left and right wings and longitudinally by front and rear stops such that when the connecting rod is rotated within the channel to rest against the front stop, the connecting rod and the grip section of the handle are substantially parallel.

5. The improved connector of claim 1 wherein the intermediate section of the connecting rod has a lateral channel to facilitate positioning of the retainer thereon.

6. The improved connector of claim 1 wherein the fastener is a thumb nut.

7. The improved connector of claim 1 wherein at least one of the seat and the handle is made of glass-filled nylon.

8. The improved connector of claim 1 wherein each of the left and right wings has a boss section forward of the transverse aperture of the handle base section.

9. The improved connector of claim 6 where the thumb nut is made from glass-filled nylon formed about a threaded rust resistant metal insert.

10. The improved connector of claim 8 wherein the handle base section channel is defined laterally by the left and right wings and longitudinally by front and rear stops such that when the connecting rod is rotated within the channel to rest against the front stop, the bosses of the left and right wings rest substantially on the concave cam surface of the seat.

11. The improved connector of claim 8 wherein the handle base section channel is defined laterally by the left and right wings and longitudinally by front and rear stops such that when the connecting rod is rotated within the channel to rest against the rear stop, the boss sections of the left and right wings are substantially disengaged from the concave cam surface of the seat.

12. The improved connector of claim 8 wherein the handle base section channel is defined laterally by the left and right wings and longitudinally by front and rear stops such that when the connecting rod is at rest against the front stop, it may be rotated within the channel through an arc of at least about ninety degrees before contacting the rear stop.

13. A method for connecting a battery cable connector of the type comprising a flat plate with an aperture therein to a battery terminal post of the type comprising a flat plate with an aperture therein through the use of a battery cable clamp of the type having a handle with a grip section and a base section, the base section having a transverse aperture and left and right wings separated by a channel; a pin received within the transverse aperture of the handle base section; a connecting rod having a proximal end connected through the channel to the pin, an intermediate section, and a threaded distal section; a seat having an aperture through which the connecting rod is received, said seat having a concave cam surface facing the handle base section and an opposed base surface; and a fastener having a threaded aperture adapt to be received on the threaded distal section of the connecting rod comprising the steps of:

(a) rotating the handle section with respect to the seat so that the bosses of the left and right wings are substantially disengaged from the concave cam surface and removing the fastener from the connecting rod;

(b) passing the distal end of the connecting rod through both the aperture of the battery cable connector and the aperture of the battery terminal post;

(c) finger tightening the fastener on the threaded distal end of the connecting rod; and (d) rotating the handle with respect to the seat so that the bosses of the left and right wings rest substantially on the concave cam surface of the seat.

14. The method of claim 13 wherein when the fastener is removed in step (a) an elastomeric washer on the connecting rod retains the seat on the connecting rod.

15. The method of claim 13 wherein the distal end of the connecting rod is first passed through the aperture of the battery cable connector and subsequently passed through the aperture of the battery terminal post and the fastener is positioned adjacent to the battery terminal post.

16. The method of claim 13 wherein the distal end of the connecting rod is first passed through the aperture of the battery terminal post and subsequently passed through the aperture of the battery cable connector and the fastener fixed adjacent to the battery cable connector.

17. A method for disconnecting connecting a battery cable connector of the type comprising a flat plate with an aperture therein from a battery terminal post of the type comprising a flat plate with an aperture therein held in contact therewith by a battery cable clamp of the type having a handle with a grip section and a base section, the base section having a transverse aperture and left and right wings separated by a channel; a pin received within the transverse aperture of the handle base section; a connecting rod having a proximal end connected through the channel to the pin, an intermediate section, and a threaded distal section; a seat having an aperture through which the connecting rod is received, said seat having a concave cam surface facing the handle base section and an opposed base surface; and a fastener having a threaded aperture adapt to be received on the threaded distal section of the connecting rod comprising the steps of:

(a) rotating the handle section with respect to the seat so that the bosses of the left and right wings are substantially disengaged from the concave cam surface and removing the fastener from the connecting rod;

(b) removing the connecting rod from the aperture of the battery cable connector and the aperture of the battery terminal post; and (c) finger tightening the fastener on the threaded distal end of the connecting rod.

18. The method of claim 17 wherein when the fastener is removed in step (a) a retainer holds the seat on the connecting rod.

19. The method of claim 18, wherein the retainer is an elastomeric washer received over the connecting rod and housed substantially within a cavity in the base surface of the seat.

* * * * *